US009641939B2

(12) United States Patent
Uchida et al.

(10) Patent No.: US 9,641,939 B2
(45) Date of Patent: May 2, 2017

(54) ACOUSTIC TRANSDUCER AND MICROPHONE

(71) Applicant: OMRON Corporation, Kyoto-shi, Kyoto (JP)

(72) Inventors: Yuki Uchida, Otsu (JP); Koji Momotani, Nagaokakyo (JP); Takashi Kasai, Kusatsu (JP)

(73) Assignee: OMRON Corporation, Kyoto-shi (JP)

( * ) Notice: Subject to any disclaimer, the term of this patent is extended or adjusted under 35 U.S.C. 154(b) by 0 days.

(21) Appl. No.: 14/859,474

(22) Filed: Sep. 21, 2015

(65) Prior Publication Data

US 2016/0094918 A1 Mar. 31, 2016

(30) Foreign Application Priority Data

Sep. 25, 2014 (JP) ..... 2014-195896

(51) Int. Cl.
*H04R 25/00* (2006.01)
*H04R 19/00* (2006.01)
*H04R 19/01* (2006.01)

(52) U.S. Cl.
CPC ..... *H04R 19/005* (2013.01); *H04R 19/013* (2013.01); *H04R 19/016* (2013.01); *H04R 2201/003* (2013.01)

(58) Field of Classification Search
CPC H04R 19/04; H04R 19/005; H04R 2201/003; H04R 2499/11; H04R 17/00; H04R 2410/03; H04R 7/04; B81B 2201/0257; B81B 3/0018
USPC ..... 381/162, 357, 173, 174, 175, 178, 113, 381/179
See application file for complete search history.

(56) References Cited

U.S. PATENT DOCUMENTS

| | | | | |
|---|---|---|---|---|
| 5,452,268 | A | 9/1995 | Bernstein | |
| 6,225,140 | B1 * | 5/2001 | Liu | G01L 9/0042 438/48 |
| 8,045,733 | B2 * | 10/2011 | Zhe | H04R 19/04 367/181 |
| 8,351,625 | B2 * | 1/2013 | Kasai | H04R 19/04 381/175 |
| 2009/0060232 | A1 * | 3/2009 | Hirade | H04R 31/00 381/174 |

FOREIGN PATENT DOCUMENTS

JP 5218432 B2 6/2013

* cited by examiner

*Primary Examiner* — Alexander Jamal
(74) *Attorney, Agent, or Firm* — Mots Law, PLLC

(57) ABSTRACT

An acoustic transducer includes a slit having higher passage resistance than in conventional structures and having a lower rate of decrease in the passage resistance than in conventional structures when, for example, the vibration electrode plate warps. The acoustic transducer includes a stationary electrode plate, and a vibration electrode plate facing the stationary electrode plate with a space between the electrode plates. The vibration electrode plate includes a slit that allows sound to pass through. The vibration electrode plate includes a resistance increasing section including at least one pair of high-resistance surfaces that constitute side surfaces of the slit in a width direction thereof, and are thicker than a middle portion of the vibration electrode plate.

16 Claims, 16 Drawing Sheets

ACOUSTIC TRANSDUCER AND MICROPHONE

FIELD

The present invention relates to an acoustic transducer and a microphone.

BACKGROUND

Recent mobile phones and other devices may typically incorporate a micro electro-mechanical systems (MEMS) microphone.

A MEMS microphone includes an acoustic transducer fabricated using MEMS technology, and an application specific integrated circuit (ASIC) for amplifying an output of the acoustic transducer, which are together accommodated in a housing.

As shown in FIG. 1A, an acoustic transducer known in the art included in a MEMS microphone may include a substrate 32 having a cavity 32*a*, a vibration electrode plate (diaphragm) 33 arranged on the substrate 32 to close the cavity 32*a*, and a stationary electrode plate 39 facing the vibration electrode plate 33.

In this acoustic transducer, the vibration electrode plate 33 transfers vibrations from its portion located on the substrate 32 toward its middle portion. The acoustic transducer shown in FIG. 1A thus has high acoustic resistance in the space between the substrate 32 and the vibration electrode plate 33. This can cause acoustic noise.

The vibration electrode plate 33 may physically separate its portion located on the substrate 32 from its middle portion to avoid direct transfer of vibrations from the portion located on the substrate 32 to the middle portion. For example, an acoustic transducer may include a vibration electrode plate 33 having a plurality of slits 37 around its middle portion as shown schematically in FIG. 1B.

CITATION LIST

Patent Literature

Patent Literature 1: U.S. Pat. No. 5,452,268
Patent Literature 2: Japanese Patent No. 5218432

SUMMARY

Technical Problem

An acoustic transducer may include a substrate 32, a stationary electrode plate 39, and a vibration electrode plate 33 arranged in the stated order. The vibration electrode plate 33 of this acoustic transducer may have a plurality of slits 37 around its middle portion to allow the middle portion to vibrate more easily.

For the acoustic transducer including the vibration electrode plate 33 with slits 37 around the middle portion, the noise floor is known to shift toward higher frequencies within the audible range (audible frequency band) shown in FIG. 2A when the resistance to the passage through each slit 37 decreases. The resistance to the passage through each slit 37 refers to the resistance to the passage of sound (or air vibration) through each slit 37.

Moreover, when the passage resistance of each slit 37 is too low, the sensitivity decreases in the low frequency region as shown in FIG. 2B. This transducer may not achieve intended sensitivity characteristics in the low frequency region.

The slits 37 in the acoustic transducer may thus need high passage resistance.

The slits 37 can have higher passage resistance when the slits 37 are narrower or when the vibration electrode plate 33 is thicker. However, large restrictions in the manufacturing processes limit the extent of narrowing of the slits 37 and thus limit the extent of increasing of the passage resistance of the slits 37. Additionally, a thicker vibration electrode plate 33 is stiffer (allowing less vibrations), and thus lowers the sensitivity of the acoustic transducer. The thickness of the vibration electrode plate 33 may not be increased to increase the passage resistance of the slits 37.

As shown in FIG. 3A, the vibration electrode plate 33 may include a slit 37 with passage resistance represented by the thickness difference between the two arrows.

During use, the acoustic transducer receives a voltage applied between the vibration electrode plate 33 and the stationary electrode plate 39. The electrostatic attraction generated between the vibration electrode plate 33 and the stationary electrode plate 39 can cause misalignment between the facing side surfaces of the slit 37 as shown schematically in FIG. 3B. This may lower the passage resistance of the slit 37.

Further, stress acting across different positions of the vibration electrode plate 33 can cause parts of the vibration electrode plate 33 near the slit 37 to warp as shown schematically in FIG. 3C. This may also lower the passage resistance of the slit 37.

In the acoustic transducer including the vibration electrode plate 33 with the slit 37, the vibration electrode plate can deform and lower the passage resistance of the slit 37.

The present invention is directed to an acoustic transducer including a vibration electrode plate with a slit having higher passage resistance than in conventional structures and having a lower rate of decrease in the passage resistance than in conventional structures when, for example, the vibration electrode plate warps.

The present invention is also directed to a high-performance microphone incorporating an acoustic transducer including a vibration electrode plate with a slit.

Solution to Problem

To respond to the above issues, one aspect of the present invention provides an acoustic transducer including a stationary electrode plate, and a vibration electrode plate facing the stationary electrode plate with a space between the electrode plates. The vibration electrode plate includes a slit that allows sound to pass through. The vibration electrode plate includes a resistance increasing section that increases resistance to passage of sound through the slit. The resistance increasing section includes at least one pair of high-resistance surfaces that constitute side surfaces of the slit in a width direction and are thicker than a middle portion of the vibration electrode plate, and the high-resistance surfaces overlap as viewed in the width direction of the slit.

More specifically, one side surface (an inner side surface, which is hereinafter referred to as a first side surface) of the slit in the width direction in the acoustic transducer according to the aspect of the present invention includes at least one portion functioning as a high-resistance surface with a thickness (dimension of the vibration electrode plate in the thickness direction) greater than a middle portion of the vibration electrode plate. The other side surface of the slit in the width direction (hereinafter referred to as a second side surface) includes a portion functioning as a high-resistance surface at a position facing the high-resistance surface of the first side surface. The slit with these first and second side surfaces allows sound passing through the slit to contact a larger portion of the slit on average than a slit formed in a vibration electrode plate with a uniform thickness (a conventional slit including side surfaces having the same uniform thickness (height) as the vibration electrode plate). In other words, the slit including the first side surface and the second side surface has higher passage resistance (resistance to the passage of sound) than the conventional slit. The slit with this structure also has a lower rate of decrease in the passage resistance than in the conventional slit when, for example, the vibration electrode plate wraps (refer to FIGS. 16A to 16C). An acoustic transducer with the structure according to the aspect of the present invention can have a slit with higher passage resistance than in conventional structures and a lower rate of decrease in the passage resistance than in conventional structures when, for example, the vibration electrode plate warps.

One or more aspects of the present invention provide the acoustic transducer according to the above aspect of the present invention in which the resistance increasing section includes surfaces at the slit each of which is shaped in a square wave (refer to FIG. 9 and FIGS. 16A to 16C), or in which the resistance increasing section includes surfaces at the slit each of which is formed by a single high-resistance surface extending in a longitudinal direction of the slit (refer to FIGS. 10A to 10C). The acoustic transducer with the former structure can be typically fabricated more easily than the acoustic transducer with the latter structure. To allow such easier fabrication, the resistance increasing section may include surfaces at the slit each of which is shaped in a square wave.

For a slit with a resistance increasing section including a plurality of pairs of high-resistance surfaces, the passage resistance will be larger as the dimension of the high-resistance surface in the longitudinal direction multiplied by the number of high-resistance surfaces is larger, if the slit is assumed to have the resistance increasing section with the same length. Forming the resistance increasing section having surfaces at the slit each shaped in a square wave (a square wave with a duty ratio of 50%) easily increases the number of high-resistance surfaces. To allow such easier increase in the number of high-resistance surfaces, the resistance increasing section may include surfaces at the slit each of which is shaped in a square wave.

The vibration electrode plate including the slit and the resistance increasing section with the surfaces at the slit each shaped in a square wave can be prepared with various methods. For example, the vibration electrode plate may be prepared by the procedure including forming a plate member including a slit structure with a longitudinal cross-section shaped in a square wave, and removing a middle portion of the slit structure in a transverse direction of the slit structure.

The resistance increasing section included in the acoustic transducer according to the aspect of the present invention protrudes from the vibration electrode plate. The resistance increasing section protruding toward the stationary electrode plate may easily stick to the stationary electrode plate, or may lower the sensitivity of the acoustic transducer. Another aspect of the present invention may be the acoustic transducer according to the above aspect of the present invention in which the resistance increasing section protrudes from the vibration electrode plate in a direction opposite to a direction toward the stationary electrode plate.

The acoustic transducer according to the aspect of the present invention typically includes the vibration electrode plate with a plurality of slits surrounding a middle portion of the vibration electrode plate. In this case, some or all of the slits may satisfy the above conditions (slits each with the resistance increasing section). The stationary electrode plate may not extend over areas outward from the slits of the vibration electrode plate. The acoustic transducer with this structure has good sensitivity. Another aspect of the present invention may be the acoustic transducer according to the above aspect of the present invention in which the vibration electrode plate includes a plurality of the slits surrounding the middle portion of the vibration electrode plate, and the stationary electrode plate is within an area defined by the plurality of slits as viewed in a direction of a normal to the vibration electrode plate, or the vibration electrode plate includes the slit shaped to surround the middle portion of the vibration electrode plate, and the stationary electrode plate is within an area defined by the slit as viewed in a direction of a normal to the vibration electrode plate.

Another aspect of the present invention provides the acoustic transducer according to the above aspect of the present invention in which a peripheral portion of the vibration electrode plate is fastened to the substrate with at least one support, or the peripheral portion of the vibration electrode plate is directly fastened to the substrate. When the acoustic transducer according to the above aspect of the present invention has the former structure, the at least one support may include a support that fastens a portion of the vibration electrode plate outward from the slit to the substrate to prevent the slit from widening when the portion of the vibration electrode plate outward from the slit deforms.

The acoustic transducer according to the aspect of the present invention typically includes the stationary electrode plate and the vibration electrode plate directly or indirectly fastened to the substrate having the cavity that opens at the first surface. However, the acoustic transducer can have higher sensitivity or a better signal-to-noise ratio when at least a portion of each slit does not face the substrate. Thus, another aspect of the present invention provides the acoustic transducer according to the aspect of the present invention in which the stationary electrode plate and the vibration electrode plate are directly or indirectly fastened to a substrate including a cavity that opens in a first surface thereof, and at least a portion of each slit is arranged more inward from the cavity than an opening rim of the cavity of the substrate at the first surface as viewed in a direction of a normal to the first surface. The acoustic transducer according to the aspect of the present invention may include the substrate, the vibration electrode plate, and the stationary electrode plate arranged in the stated order, or may include the substrate, the stationary electrode plate, and the vibration electrode plate arranged in the stated order.

Another aspect of the present invention provides the acoustic transducer according to the above aspect of the present invention in which a peripheral portion of the vibration electrode plate is fastened to the substrate with at least one support. The peripheral portion of the vibration electrode plate may be directly fastened to the substrate. When the acoustic transducer according to the above aspect of the present invention has the former structure, the at least one support may include a support that fastens a portion of the vibration electrode plate outward from the slit to the substrate to prevent the slit from widening when the portion of the vibration electrode plate outward from the slit deforms.

Another aspect of the present invention provides the acoustic transducer according to the above aspect of the present invention further including a back plate to which the stationary electrode plate is attached, in which a portion of the back plate facing each slit includes no acoustic hole. This structure prevents air through the slit from directly passing through the acoustic holes in the back plate. This further increases the passage resistance of the slit.

Another aspect of the present invention provides an acoustic transducer including a back plate, a stationary electrode plate attached to the back plate, and a vibration electrode plate facing the stationary electrode plate with a space between the electrode plates. The vibration electrode plate includes a slit that allows sound to pass through. A portion of the back plate facing the slit has no acoustic hole.

In the acoustic transducer according to the aspect of the present invention, air through the slit does not directly pass through the acoustic holes formed through the back plate (or both the back plate and the stationary electrode plate). The acoustic transducer according to the aspect of the present invention has a slit with higher passage resistance than in a conventional acoustic transducer in which acoustic holes are formed in an area of the back plate (or both the back plate and the stationary electrode plate) facing the slit, and with a lower rate of decrease in the passage resistance when, for example, the vibration electrode plate warps.

Another aspect of the present invention provides a microphone including the acoustic transducer according to one of the above aspects of the present invention, and an integrated circuit configured to amplify an output of the acoustic transducer.

The microphone according to the aspect of the present invention includes an acoustic transducer that has higher passage resistance than a conventional acoustic transducer, and has a lower rate of decrease in the passage resistance when, for example, the vibration electrode plate warps. The microphone according to the aspect of the present invention thus has higher performance than an acoustic transducer including a vibration electrode plate with a simple slit.

Advantageous Effects

The acoustic transducer according to one or more embodiments of the present invention includes a vibration electrode plate with a slit having higher passage resistance than in conventional structures and having a lower rate of decrease in the passage resistance than in conventional structures when, for example, the vibration electrode plate warps. The microphone according to one or more embodiments of the present invention incorporates an acoustic transducer including such a vibration electrode plate with a slit.

DETAILED DESCRIPTION

Embodiments of the present invention will now be described with reference to the drawings. The invention should not be limited to the embodiments described below, but may be modified variously without departing from the scope and spirit of the invention. Although the embodiments are directed to acoustic transducers for microphones, the invention is also applicable to acoustic transducers for speakers.

Figure 4:
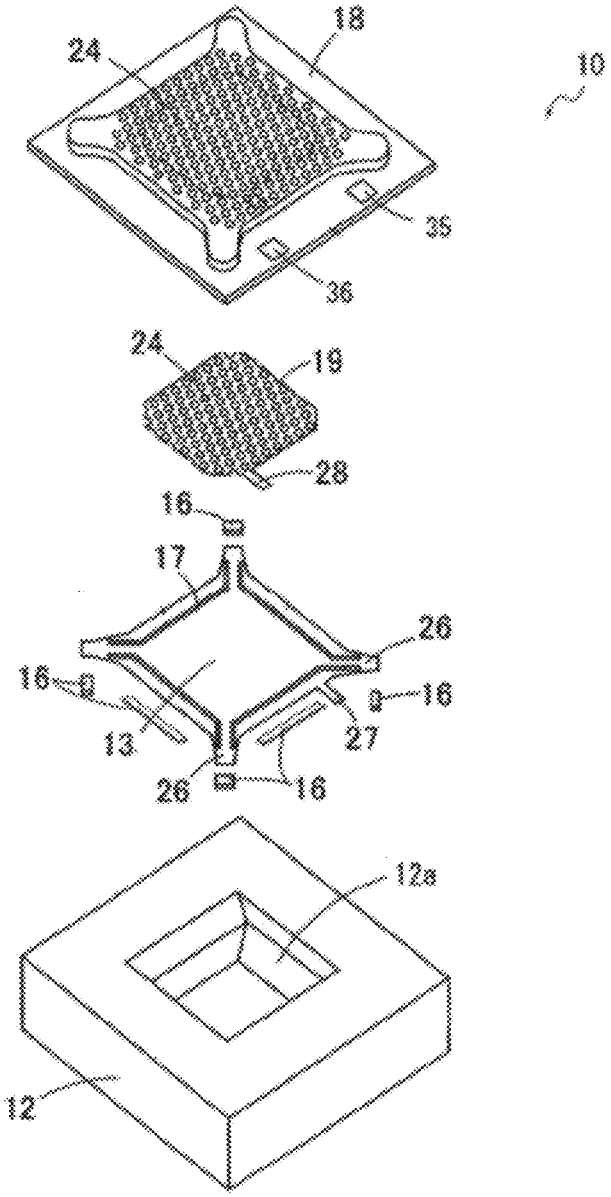
FIG. 4 is an exploded perspective view of an acoustic transducer according to one embodiment of the present invention.
Figure 5:
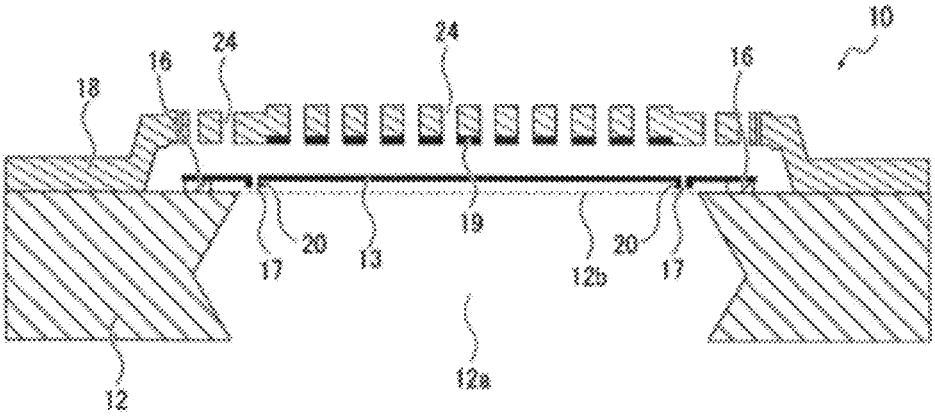
FIG. 5 is a cross-sectional view of the acoustic transducer according to the embodiment.
Figure 6:
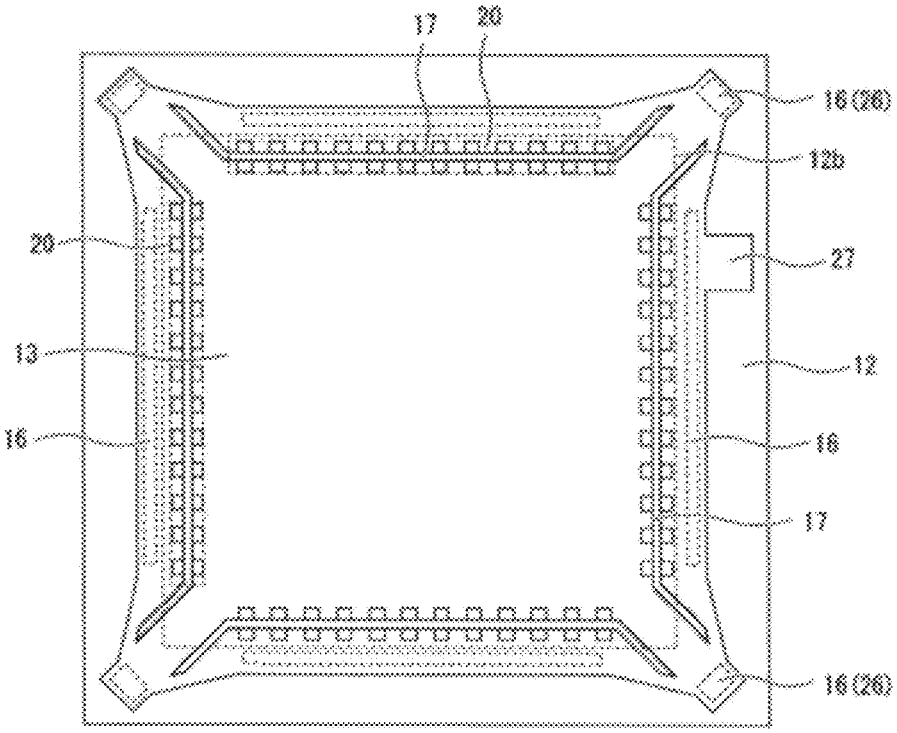
FIG. 6 is a top view of the acoustic transducer in which a back plate and a stationary electrode plate are not shown.
Figure 7A:
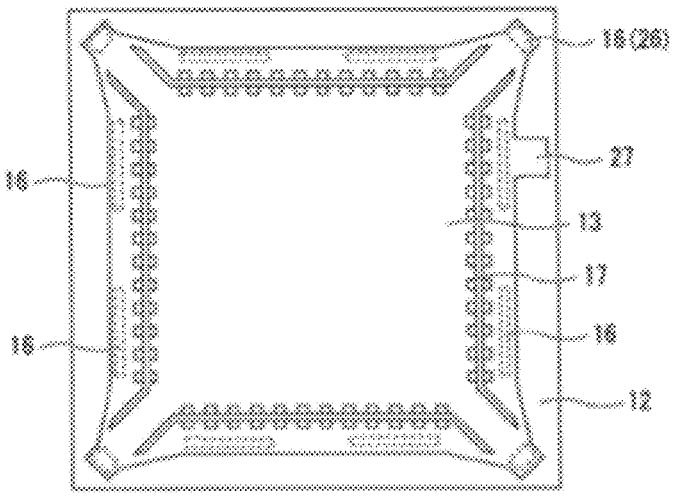
FIGS. 7A and 7B are diagrams describing structures that can be used to fasten a vibration electrode plate to a substrate.
Figure 7B:
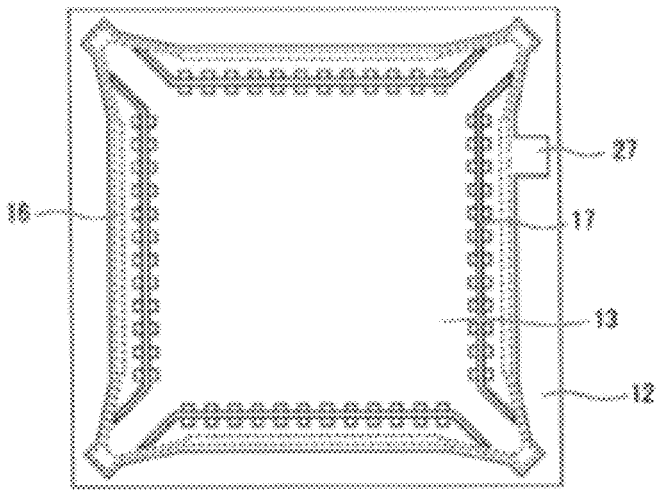
Figure 8:
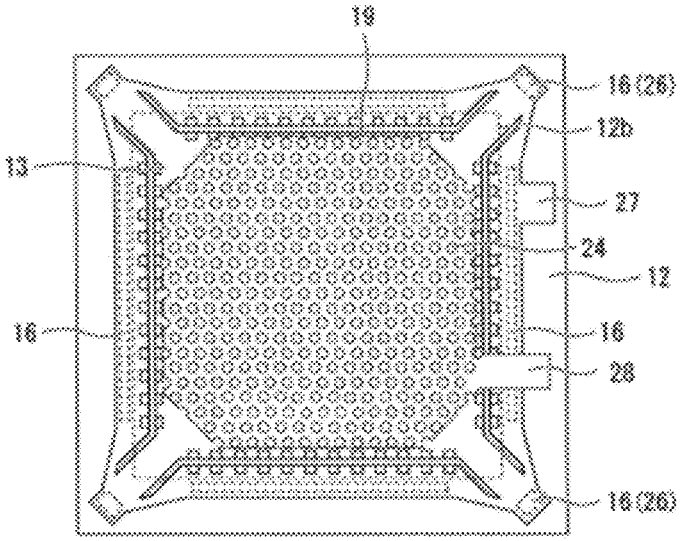
FIG. 8 is a top view of the acoustic transducer in which the back plate is not shown.

The overall structure of an acoustic transducer 10 according to one embodiment of the invention will now be described with reference to FIGS. 4 to 8. FIG. 4 is an exploded perspective view of the acoustic transducer 10 according to the present embodiment. FIG. 5 is a cross-sectional view of the acoustic transducer 10. FIG. 6 is a top view of the acoustic transducer 10 in which a back plate 18 and a stationary electrode plate 19 are not shown. FIGS. 7A and 7B are diagrams showing structures that can be used to fasten a vibration electrode plate 13 to a substrate 12. FIG. 8 is a top view of the acoustic transducer 10 in which the back plate 18 is not shown. Hereafter, "upper" and "lower" refer to the upper and lower parts in the figures including FIGS. 4 and 5.

The acoustic transducer 10 according to the present embodiment is a capacitive transducer fabricated using MEMS technology. As shown in FIGS. 4 and 5, the acoustic transducer 10 includes a substrate 12, a vibration electrode plate (diaphragm) 13, a back plate 18, and a stationary electrode plate 19 as its main components.

The substrate 12 is a silicon substrate having a cavity 12*a*, which is formed through the substrate 12 and thus extends from the upper surface to the lower surface of the substrate 12. The cavity 12*a* in the substrate 12 shown in FIGS. 4 and 5 is defined by (111) surfaces of the (100) surface silicon substrate and by surfaces equivalent to the (111) surfaces as its wall surfaces. In some embodiments, the cavity 12*a* in the substrate 12 may have other wall surfaces (e.g., perpendicular wall surfaces).

The vibration electrode plate 13 included in the acoustic transducer 10 is a thin polysilicon layer. As shown in FIGS. 4 and 6, the vibration electrode plate 13 is substantially rectangular. The vibration electrode plate 13 includes legs 26 in the corners, which are fastened to the substrate 12 with supports 16. The vibration electrode plate 13 further includes a wiring unit 27 on its one side, which is electrically connected to an electrode pad 35 arranged on the upper surface of the back plate 18.

The vibration electrode plate 13 has four slits 17 around its middle portion. Each slit 17 includes a straight portion that extends substantially parallel to the corresponding peripheral side of the vibration electrode plate 13, and includes end portions that extend in the direction where the corresponding legs 26 are arranged. As shown in FIG. 6 (and FIG. 5), the straight portion of each slit 17 is located more inward from the rim of an upper opening 12*b* of the cavity 12*a*. The straight portion of each slit 17 has a resistance increasing section 20 (described in detail later).

As shown in FIG. 6, the area of the vibration electrode plate 13 outward from each slit 17 includes its middle portion used to fasten the vibration electrode plate 13 to the substrate 12 with the corresponding support 16. In some embodiments, the vibration electrode plate 13 may be fastened to the substrate 12 with a structure different from the structure shown in FIG. 6. As shown in FIG. 7A, for example, the area of the vibration electrode plate 13 outward from each slit 17 may include a plurality of portions fastened to the substrate 12 with a plurality of supports 16 (two supports 16 in FIG. 7A). In some other embodiments, the vibration electrode plate 13 may be fastened to the substrate 12 with a single support 16 that extends along the outer periphery of the vibration electrode plate 13 as shown in FIG. 7B.

The portions of the vibration electrode plate 13 outward from each slit 17 may not be fastened to the substrate 12. In this case, the portions of the vibration electrode plate 13 outward from each slit 17 may deform to increase the width of each slit 17. Thus, the vibration electrode plate 13 may be fastened to the substrate 12 using the structure shown in FIG. 6, FIG. 7A, or FIG. 7B. In other words, the portions of the vibration electrode plate 13 outward from each slit 17 may be fastened to the substrate 12 using any structure.

The stationary electrode plate 19 included in the acoustic transducer 10 is a thin polysilicon layer. As shown in FIG. 8, the stationary electrode plate 19 is shaped to fit into the middle portion of the vibration electrode plate 13 surrounded by the four slits 17. The stationary electrode plate 19 has a wiring unit 28 on its one side. The wiring unit 28 is electrically connected to an electrode pad 36 (refer to FIG. 4) arranged on the upper surface of the back plate 18.

The back plate 18 (refer to FIGS. 4 and 5) is formed from SiN. The stationary electrode plate 19 is fastened to the lower surface of the back plate 18. The back plate 18 is shaped to leave a space with a predetermined value between the vibration electrode plate 13 and the stationary electrode plate 19. The stationary electrode plate 19 is fastened to the back plate 18 to face the middle portion of the vibration electrode plate 13 surrounded by the four slits 17.

As shown in FIG. 5, the back plate 18 and the stationary electrode plate 19 have a plurality of acoustic holes 24 in their overlapping portions. These acoustic holes 24 are formed through the back plate 18 and the stationary electrode plate 19. The back plate 18 further has a plurality of acoustic holes 24 in its other portion that does not overlap with the stationary electrode plate 19 and does not face the slits 17. These acoustic holes 24 are formed through the back plate 18. More specifically, the acoustic transducer 10 according to the present embodiment has no acoustic holes 24 in the portion of the back plate 18 facing the slits 17 (where the stationary electrode plate 19 does not overlap).

The portion of the back plate 18 that does not face the slits 17 and the stationary electrode plate 19 may have the acoustic holes 24 arranged in any pattern. The acoustic holes 24 may be arranged in a triangular lattice, a rectangular lattice, a concentric circle, or an irregular pattern.

The structure of the vibration electrode plate 13 included in the acoustic transducer 10 will now be described in more detail.

As described above, each slit 17 of the vibration electrode plate 13 has the resistance increasing section 20.

The resistance increasing section 20 increases the resistance to the passage of sound through the slit 17 (more specifically, the straight portion of the slit 17). The resistance increasing section 20 includes at least one pair of high-resistance surfaces that constitute the side surfaces of the slit 17 in the width direction and are thicker than the middle portion of the vibration electrode plate 13. The high-resistance surfaces overlap as viewed in the width direction of the slit 17.

Figure 9:
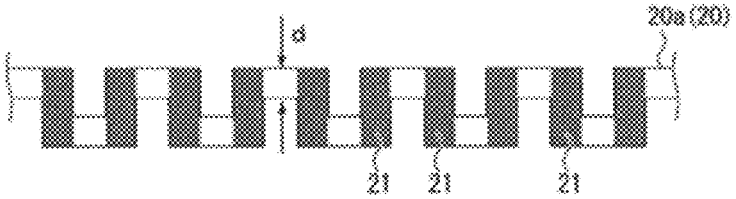
FIG. 9 is a diagram describing a resistance increasing section.
Figure 10A:
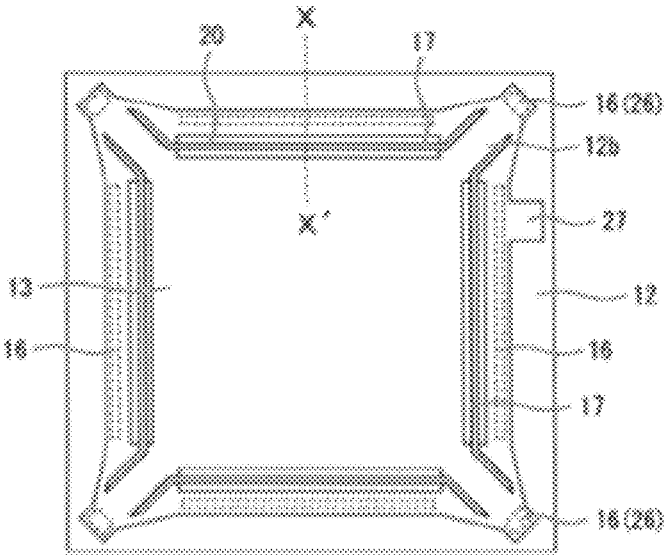
FIGS. 10A to 10C are diagrams describing the resistance increasing section.
Figure 10B:
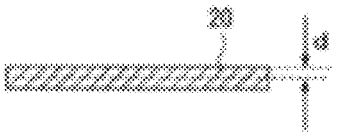
Figure 10C:
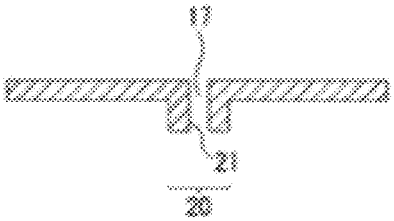

The resistance increasing section 20 will now be described in more detail with reference to FIGS. 9 and 10A to 10C. FIG. 9 is a diagram describing the structure of the resistance increasing section 20. In FIG. 9 and FIGS. 10A to 10C, d represents the thickness of the middle portion of the vibration electrode plate 13 (the thickness of the portion of the vibration electrode plate 13 excluding areas near each slit 17). FIG. 10A is a top view of an acoustic transducer including a resistance increasing section 20 with another structure, in which the back plate 18 and the stationary electrode plate 19 are not shown. FIG. 10C is a cross-sectional view of the resistance increasing section 20 taken along line X-X' in FIG. 10A. FIG. 10B is an enlarged cross-sectional view taken in the direction perpendicular to the cross-sectional view of the resistance increasing section 20 along line X-X'.

As described above, the resistance increasing section 20 includes at least one pair of high-resistance surfaces that constitute the side surfaces of the slit 17 in the width direction and are thicker than the middle portion of the vibration electrode plate 13. The high-resistance surfaces overlap as viewed in the width direction of each slit 17.

Thus, the resistance increasing section 20 may include a pair of facing portions 20*a* with their surfaces at each slit 17 (the inner side surfaces of the slit 17) shaped in the manner shown in FIG. 9. In FIG. 9, the shaded areas 21 are the high-resistance surfaces 21 with the thickness (the dimension of the vibration electrode plate 13 in the thickness direction) greater than the thickness of the middle portion of the vibration electrode plate 13. As shown in FIGS. 10A to 10C, the resistance increasing section 20 may include a pair of high-resistance surfaces 21 that extends in the longitudinal direction of each slit 17.

The vibration electrode plate 13 including such resistance increasing sections 20 shaped in the manner described above can be prepared by various procedures.

Figure 11A:
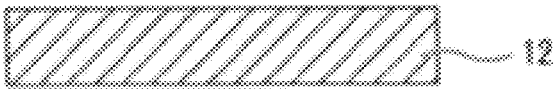
FIGS. 11A(a) to 11A(f) are diagrams describing a procedure for preparing the vibration electrode plate.
Figure 11A:
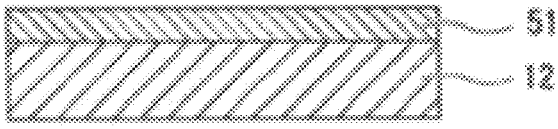
Figure 11A:
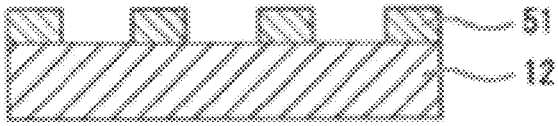
Figure 11A:
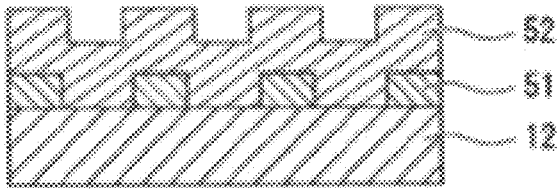
Figure 11A:
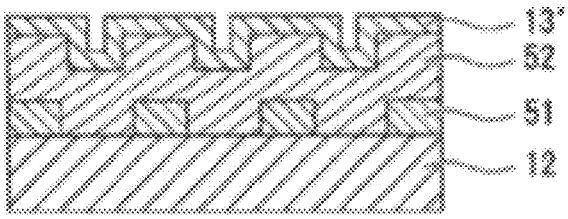
Figure 11A:
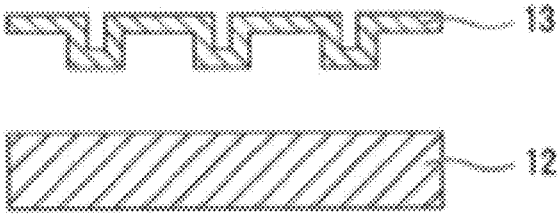
Figure 12:
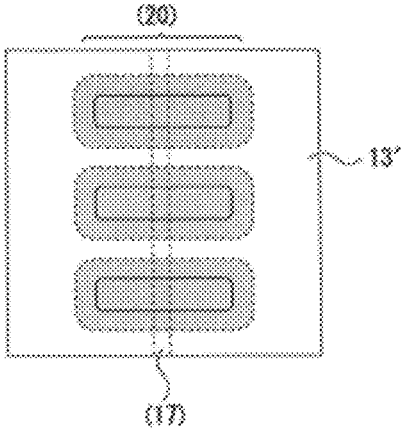
FIG. 12 is a plan view of a member formed on a second sacrificial layer.

A procedure for preparing the vibration electrode plate 13 in which each resistance increasing section 20 includes a pair of facing portions 20*a* with surfaces at the corresponding slit 17 shaped as shown in FIG. 9 will now be described with reference to FIGS. 11A(a) to 11A(f) and FIG. 12. FIGS. 11A(a) to 11A(f) are diagrams describing the procedure for preparing the vibration electrode plate 13. FIG. 12 is a plan view of a member 13' formed on a second sacrificial layer 52.

To prepare the vibration electrode plate 13, a first sacrificial layer 51 is first formed on the substrate 12 as shown in FIGS. 11A(a) and 11A(b). The first sacrificial layer 51 is, for example, a polysilicon film or a $SiO_2$ film. Subsequently, a plurality of recesses are formed in the surface of the first sacrificial layer 51 by forming a resist pattern and performing etching and other processes. Each recess extends along the central line of an area in which the straight portion of the slit 17 is to be formed. (FIG. 11A(c)).

Subsequently, a $SiO_2$ film or the like is deposited onto the first sacrificial layer 51 with the recesses to form a second sacrificial layer 52 with the surface shaped in conformance with the surface of the first sacrificial layer 51 (FIG. 11A(d)). More specifically, the second sacrificial layer 52 with recesses slightly smaller than the recesses of the first sacrificial layer 51 is formed on the recesses of the first sacrificial layer 51. The recesses in the second sacrificial layer 52 are used to form the shaded portions in FIG. 12 in a member 13' corresponding to the vibration electrode plate 13 before the slits 17 are formed (to be the main portion of each resistance increasing section 20 after the slit 17 is formed).

Subsequently, a polysilicon film is formed on the second sacrificial layer 52 to form the member 13' (FIG. 11A(e)). This is then followed by the processes including forming the slit 17 in the member 13'. This completes the vibration electrode plate 13 including the resistance increasing section 20 with a pair of facing portions 20*a* having their surfaces at the slit 17 shaped as shown in FIG. 9.

Figure 11B:
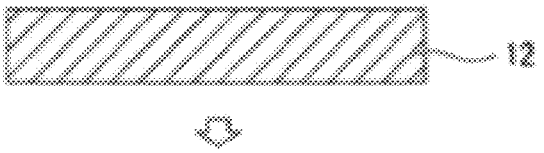
FIGS. 11B(a) to 11B(e) are diagrams describing another procedure for preparing the vibration electrode plate.
Figure 11B:
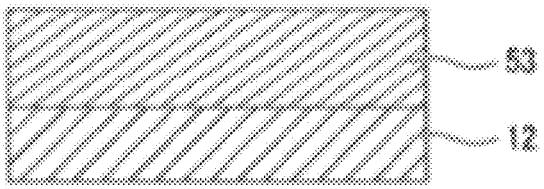
Figure 11B:
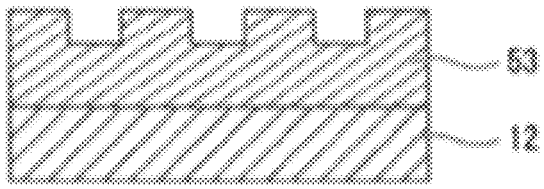
Figure 11B:
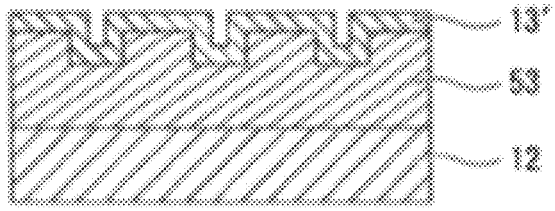
Figure 11B:
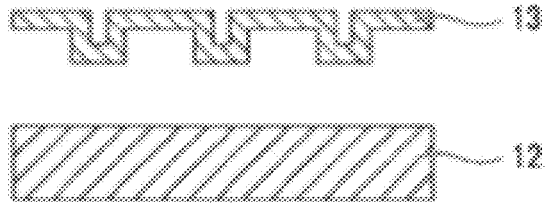

As shown in FIGS. 11B(a) to 11B(c), the vibration electrode plate 13 with the above structure may also be prepared by forming a sacrificial layer 53 on the substrate 12 and then forming a plurality of recesses in the surface of the sacrificial layer 53. Although this procedure is simpler than the procedure described with reference to FIGS. 11A(a) to 11A(f), the etching time in this procedure determines the depth of each recess in the sacrificial layer 53. With this procedure, the depth of each recess in the sacrificial layer 53 can vary across different positions of a wafer. As a result, acoustic transducers 10 produced from the single wafer can vary in the specific shape of their resistance increasing sections 20. With the procedure described with reference to FIGS. 11A(a) to 11A(f), the thickness of the sacrificial layer 51 determines the depth of each recess of the sacrificial layer 52. With the procedure described with reference to FIGS. 11A(a) to 11A(f), acoustic transducers 10 produced from a single wafer can include resistance increasing sections 20 with the same shape.

The second sacrificial layer 52 or the sacrificial layer 53 may have each recess with corners where two lines (two line segments) meet (e.g., a rectangular recess). The resultant vibration electrode plate 13 also includes corners where two lines meet. Stress can concentrate on such corners. The acoustic transducer 10 can thus have low durability against drop impacts. If the corners each have a radius of curvature R, stress does not concentrate on the corners. In this case, the acoustic transducer 10 will have high durability against drop impacts.

Figure 13:
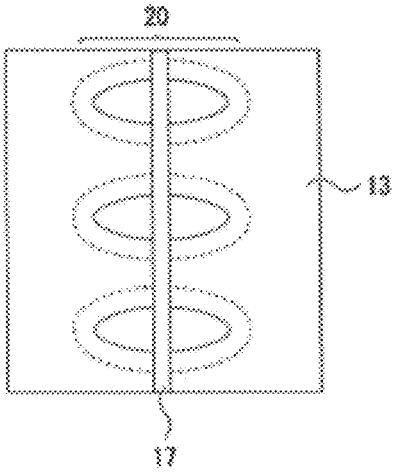
FIG. 13 is a diagram describing a resistance increasing section shaped to avoid stress concentrating on its corners.

The vibration electrode plate 13 (member 13') designed and prepared may include the resistance increasing section 20 with at least corners excluding its corners near the slit 17 to have the radius of curvature R as shown in FIG. 12. The recess formed in the second sacrificial layer 52 or in the sacrificial layer 53 (refer to FIGS. 11A(d) and 11B(d)) may be oval to allow the surface portion of the vibration electrode plate 13 near the slit 17 to be shaped as shown in FIG. 13.

Figure 14:
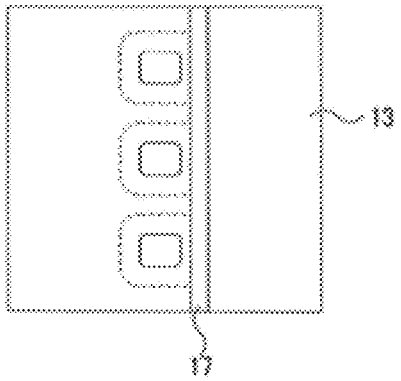
FIG. 14 is a diagram describing problems that may occur when the second sacrificial layer has an excessively narrow recess.

When the recess formed in the second sacrificial layer 52 or in the sacrificial layer 53 is too narrow, misalignment during formation of the slit 17 can cause the vibration electrode plate 13 shown in FIG. 14 to have no high-resistance surface on one side of the slit 17. To sufficiently overcome this, the vibration electrode plate 13 includes at least one pair of facing high-resistance surfaces on both sides of the slit 17. The recess in the second sacrificial layer 52 or the sacrificial layer 53 may be wide enough to allow the resistance increasing section 20 to extend across both sides of the slit 17 when the slit 17 undergoes misalignment.

As described above, the vibration electrode plate 13 included in the acoustic transducer 10 according to the present embodiment includes the resistance increasing section 20 with at least one pair of high-resistance surfaces constituting the side surfaces of the slit 17 in the width direction and thicker than the middle portion of the vibration electrode plate 13. The high-resistance surfaces overlap as viewed in the width direction of the slit 17. Thus, the acoustic transducer 10 includes each slit 17 having higher passage resistance than in conventional structures and having a lower rate of decrease in the passage resistance than in conventional structures when, for example, the vibration electrode plate 13 warps.

The acoustic transducer 10 will now be compared with a conventional acoustic transducer (refer to FIG. 1B) including a vibration electrode plate 33 with the same thickness as the vibration electrode plate 13 of the acoustic transducer 10. The inner side surfaces 18*a* and 18*b* of the slit 17 in the acoustic transducer 10 have the shape shown in FIGS. 15A and 16A (the shape of a square wave).

Figure 15A:
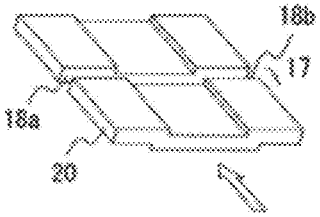
FIGS. 15A to 15C are diagrams describing the function of a slit formed in the acoustic transducer.
Figure 15B:
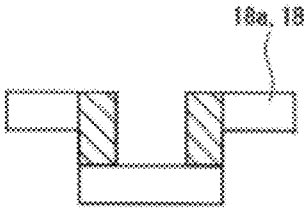
Figure 15C:
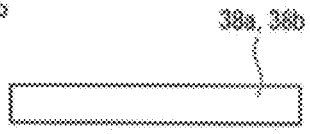
Figure 16A:
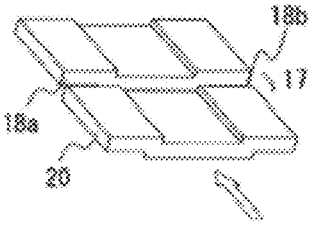
FIGS. 16A to 16C are diagrams showing the function of a slit formed in the acoustic transducer.
Figure 16B:
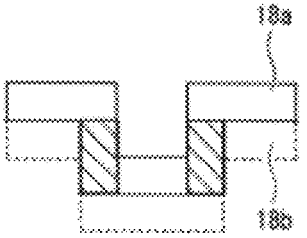
Figure 16C:
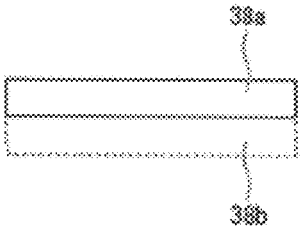

FIG. 15A is a perspective view of the part of the acoustic transducer 10 near the slit 17 without misalignment between the inner side surfaces 18*a* and 18*b*. FIG. 16A is a perspective view of the same part with misalignment corresponding to the height of the slit 17 between the inner side surfaces 18*a* and 18*b* of the slit 17. FIGS. 15B and 16B are diagrams describing the area of the overlap between the inner side surfaces 18*a* and 18*b* of the slit 17 in FIGS. 15A and 16A as viewed in the width direction of the slit 17 (in the direction of the arrow in FIGS. 15A and 16A). FIG. 15C is a diagram describing the area of the overlap between inner side surfaces 38*a* and 38*b* of a slit 37 in an acoustic transducer with the structure known in the art without misalignment between the inner side surfaces 38*a* and 38*b*. FIG. 16C is a diagram describing the area of the overlap between the inner side surfaces 38*a* and 38*b* of the slit 37 with misalignment corresponding to the height of the slit 37 (the height of the slit 17) between the inner side surfaces 38*a* and 38*b*.

The passage resistance of the slit (slit 17 or 37) is higher as the area of the overlap between the pair of facing side surfaces of the slit is larger.

The resistance increasing section 20 of the slit 17 includes at least one pair of high-resistance surfaces that constitute the side surfaces of the slit 17 in the width direction and are thicker than the middle portion of the vibration electrode plate 13. The inner side surfaces 18*a* and 18*b* of the slit 17 are larger than the side surfaces 38*a* and 38*b* of the slit 37. In addition, the high-resistance surfaces of the resistance increasing section 20 overlap with each other as viewed in the width direction of the slit 17. Without misalignment between the side surfaces, as shown in FIGS. 15A to 15C, the area of the overlap between the inner side surfaces 18*a* and 18*b* of the slit 17 (FIG. 15B) is greater than the area of the overlap between the inner side surfaces 38*a* and 38*b* of the slit 37 (FIG. 15C) by the size of the hatched area.

With misalignment corresponding to the height of the slit 37 between the inner side surfaces 38*a* and 38*b* of the slit 37 that may occur when, for example, the vibration electrode plate 33 warps, the inner side surfaces 38*a* and 38*b* have no overlap area as shown in FIG. 16C. Such misalignment corresponding to the height of the slit 37 (the thickness of the vibration electrode plate 33) between the inner side surfaces 38*a* and 38*b* greatly lowers the passage resistance of the slit 37.

With misalignment corresponding to the same amount as described above between the inner side surfaces 18*a* and 18*b* of the slit 17, the inner side surfaces 18*a* and 18*b* overlap with each other in the hatched areas shown in FIG. 16B. With misalignment corresponding to the height of the slit 17 (the thickness of the vibration electrode plate 13) between the inner side surfaces 18*a* and 18*b* of the slit 17, the passage resistance of the slit 17 decreases by a lower rate than the passage resistance of the slit 37 when the amount of misalignment of the slit 37 is the same as described above.

As described above, the acoustic transducer 10 according to the present embodiment includes the resistance increasing section 20 in each slit 17 having higher passage resistance than in conventional structures and having a lower rate of decrease in the passage resistance than in conventional structures when, for example, the vibration electrode plate 13 warps.

Figure 1A:
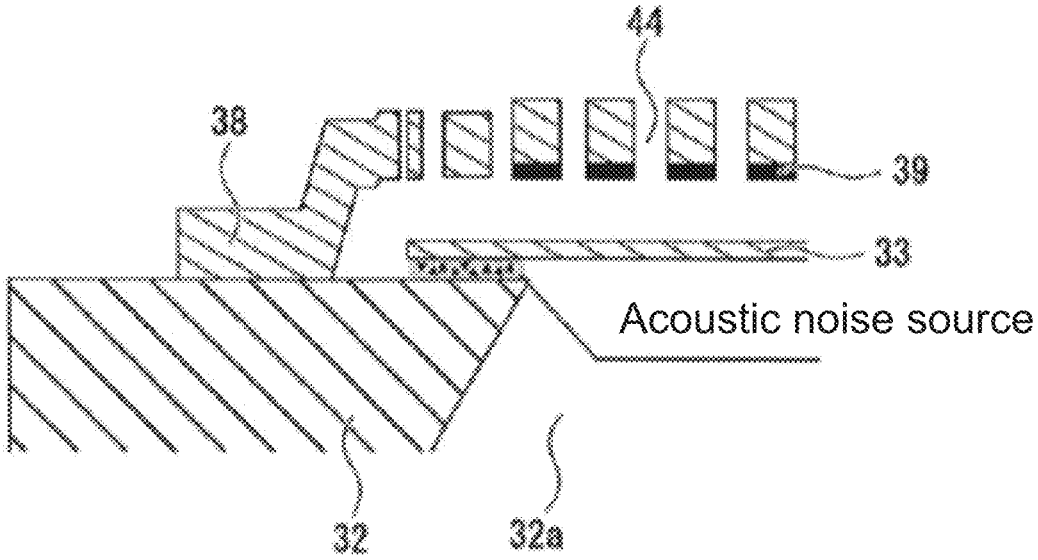
FIGS. 1A and 1B are diagrams describing the structure of an acoustic transducer known in the art.
Figure 1B:
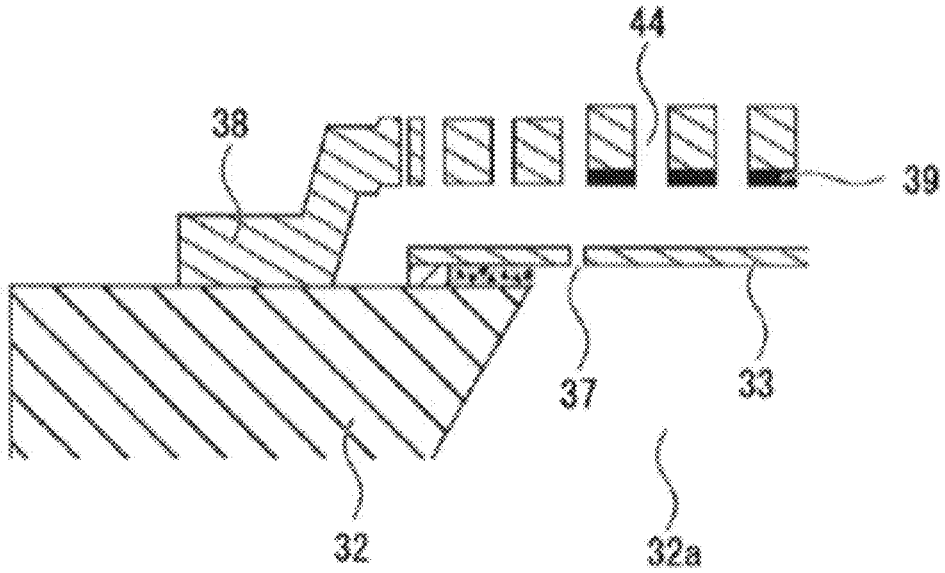
Figure 2A:
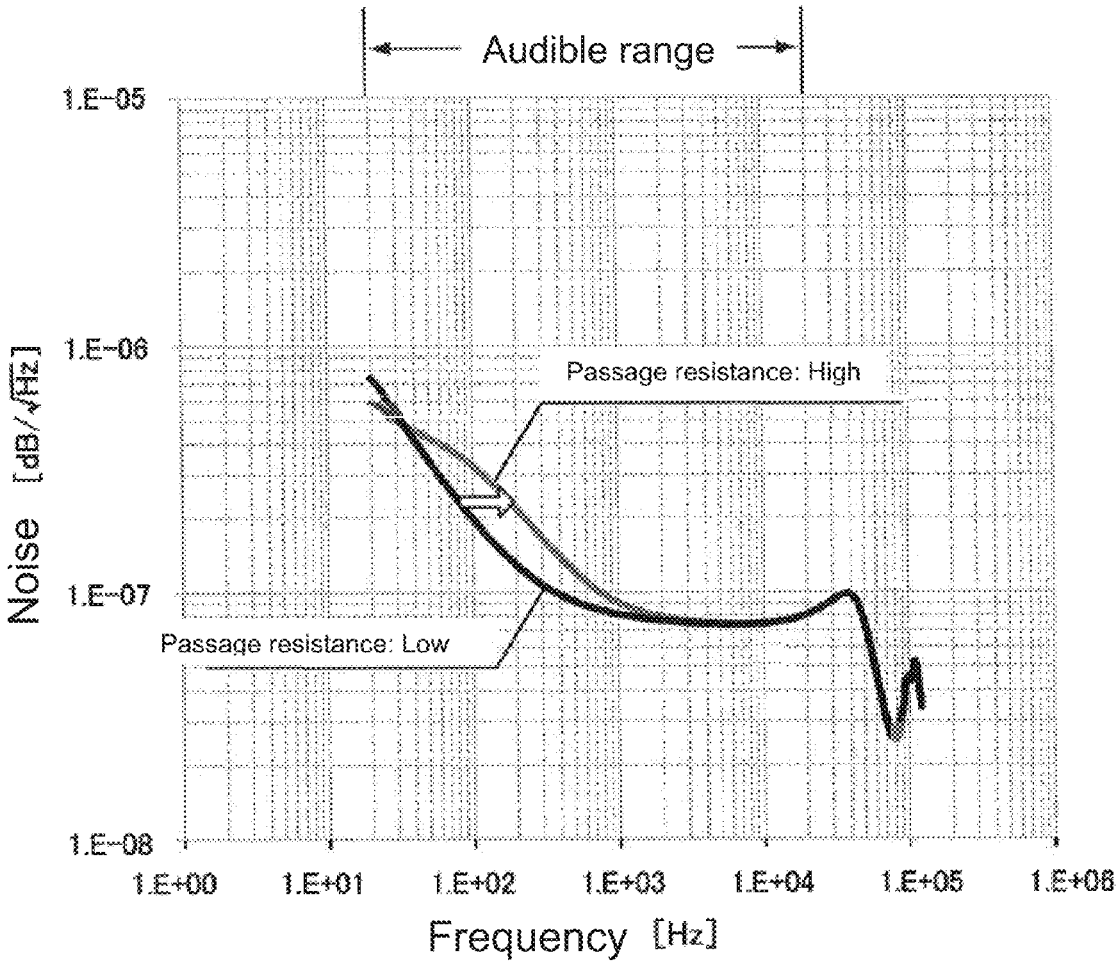
FIG. 2A is a graph showing the relationship between the passage resistance of a slit and the noise.
Figure 2B:
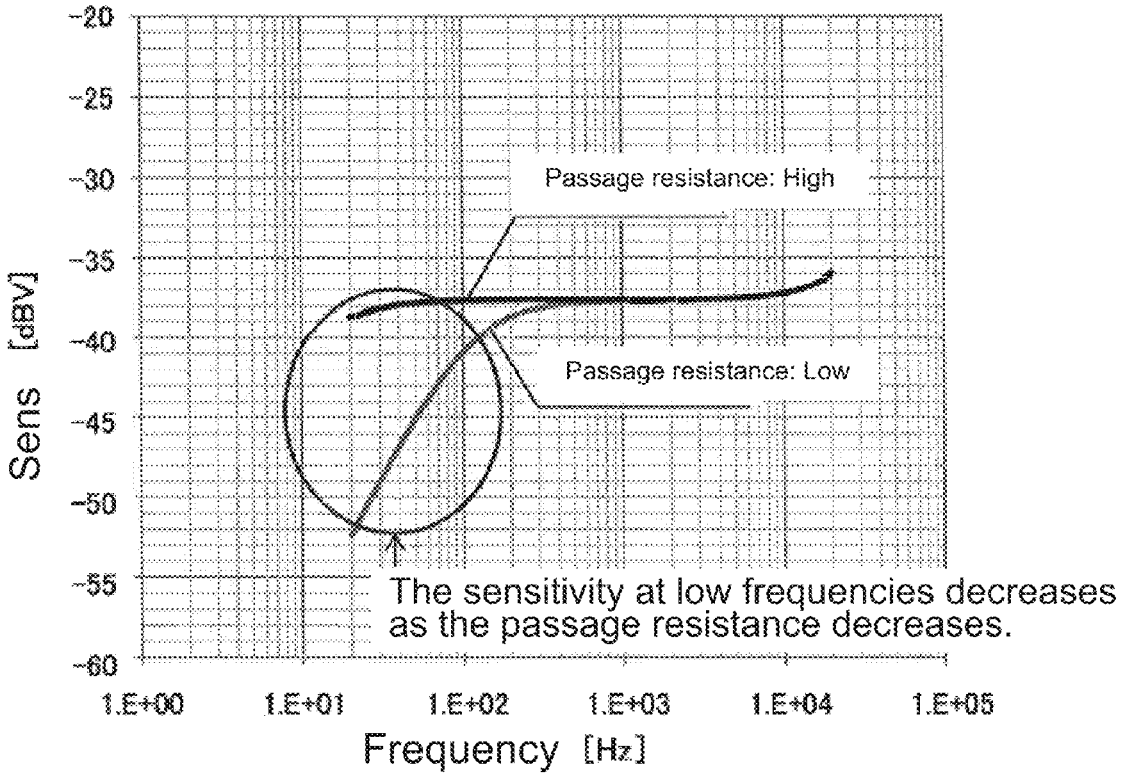
FIG. 2B is a graph showing the relationship between the passage resistance of a slit and the sensitivity.
Figure 3A:
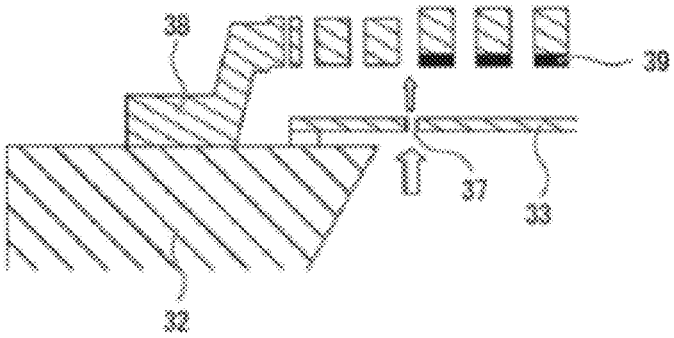
FIGS. 3A to 3C are diagrams describing problems that may occur in an acoustic transducer including a vibration electrode plate with a slit.
Figure 3B:
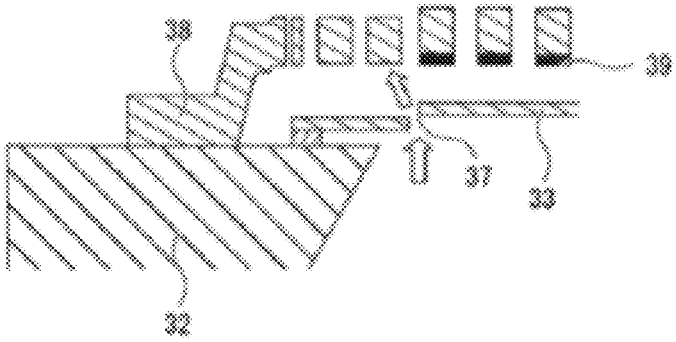
Figure 3C:
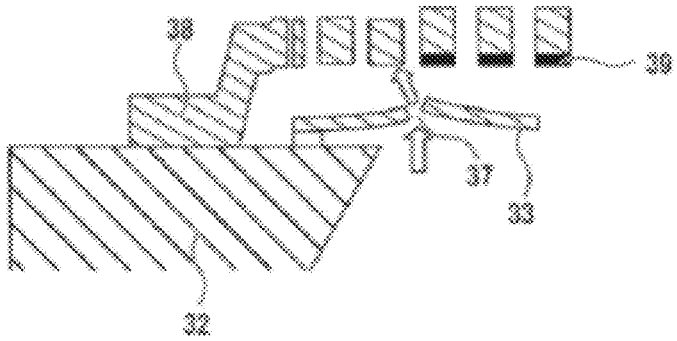
Figure 17:
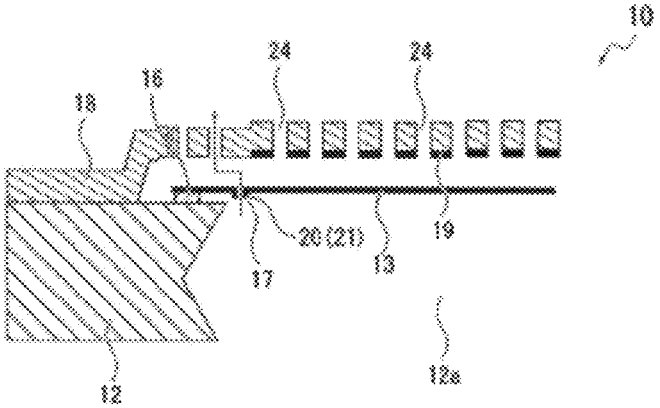
FIG. 17 is a diagram describing the advantage of forming no acoustic hole facing a slit.

In the acoustic transducer 10, the back plate 18 has no acoustic hole 24 in its portion facing each slit 17. As shown schematically in FIG. 17, the acoustic transducer 10 does not allow sound (air vibration) through each slit 17 to directly pass through the acoustic holes 24 of the back plate 18. Without the sound through each slit 17 directly passing through the acoustic holes 24 of the back plate 18, the acoustic transducer 10 has each slit 17 having higher passage resistance than in the acoustic transducer having the structure known in the art (FIG. 1B).

Microphone Including Acoustic Transducer 10

Figure 18:
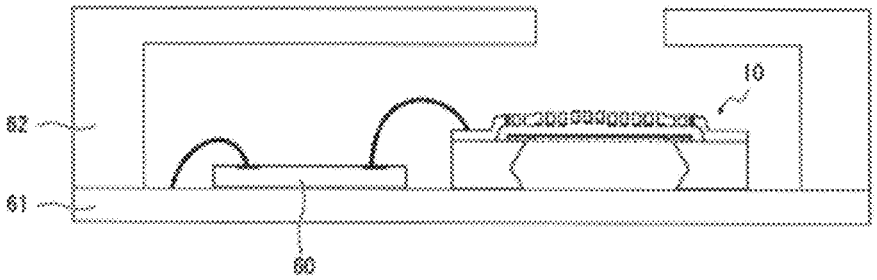
FIG. 18 is a diagram showing a microphone that can be fabricated using the acoustic transducer.

As described above, the acoustic transducer 10 has each slit 17 having higher passage resistance than in conventional structures and having a lower rate of decrease in the passage resistance than in conventional structures when, for example, the vibration electrode plate 13 warps. As shown in FIG. 18, a microphone may include the acoustic transducer 10 and an ASIC 60 for amplifying an output of the acoustic transducer 10, which are accommodated in a package incorporating a circuit board 61 and a cover 62. This microphone can have higher performance than microphones known in the art. Although the microphone shown in FIG. 18 receives sound input through the cover 62, another microphone fabricated using the acoustic transducer 10 may receive sound input through the circuit board 61 (through the cavity 12*a*).

Modifications

Figure 19:
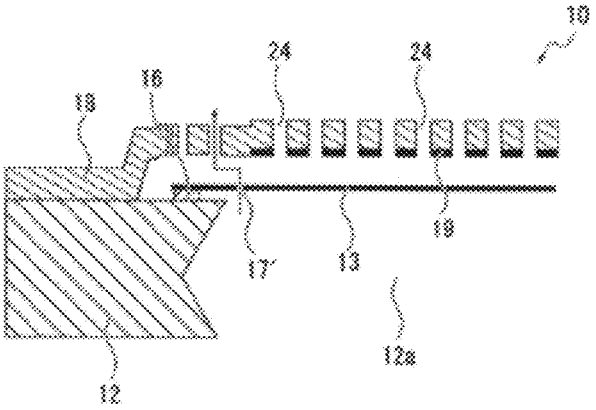
FIG. 19 is a diagram describing an acoustic transducer according to a modification of the embodiment.

The acoustic transducer 10 according to the above embodiment may be modified variously. As shown in FIG. 19, for example, the acoustic transducer 10 may be modified to have no acoustic hole 24 in the portion facing each slit 17 of the back plate 18 (the vibration electrode plate 13 may have a simple slit 17').

The acoustic transducer 10 may include a circular vibration electrode plate 13 having an arc-shaped slit 17 and a resistance increasing section 20. The acoustic transducer 10 may include a conductive layer on the substrate 12 to output a capacitance between the part of the vibration electrode plate 13 outward from the slit 17 and the substrate 12.

Figure 20:
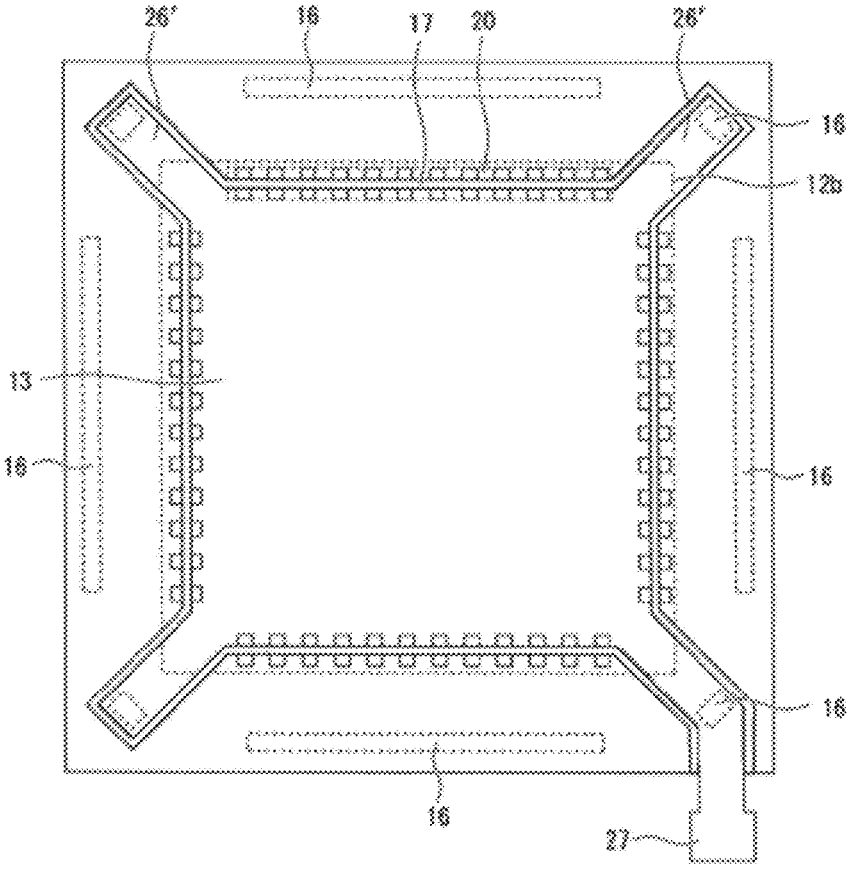
FIG. 20 is a diagram describing an acoustic transducer according to a modification of the embodiment.

As shown in FIG. 20, the vibration electrode plate 13 in the acoustic transducer 10 may include a single slit 17 surrounding a rectangular middle portion of the vibration electrode plate 13 and fastening parts 26' extending diagonally from the corners of the rectangular portion. The acoustic transducer 10 including this slit 17 can function properly when the fastening parts 26' and the corresponding portions (four portions in FIG. 20) of the vibration electrode plate 13 are fastened to the substrate 12 with supports 16.

Figure 21:
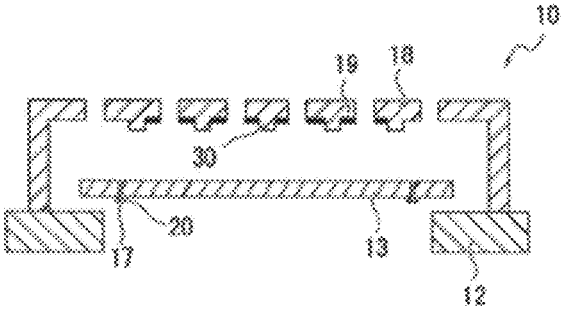
FIG. 21 is a diagram describing an acoustic transducer according to a modification of the embodiment.

To reduce sticking between the vibration electrode plate 13 and the stationary electrode plate 19, stoppers 30 may be arranged on the back plate 18 of the acoustic transducer 10 as shown schematically in FIG. 21.

Although the acoustic transducer 10 described above includes the substrate 12, the vibration electrode plate 13, and the stationary electrode plate 19 arranged in the stated order, the acoustic transducer 10 may include the substrate 12, the stationary electrode plate 19, and the vibration electrode plate 13 arranged in the stated order. The stationary electrode plate 19 may be arranged on the substrate 12 and the vibration electrode plate 13 may be arranged on the stationary electrode plate 19 in, for example, the structure shown in FIG. 22A or FIG. 22B. In this structure, the back plate 18 and the stationary electrode plate 19 may constitute the structure shown in FIG. 22A (the structure for supporting the vibration electrode plate 13), on which the vibration electrode plate 13 is arranged. In another embodiment, as shown in FIG. 22B, the vibration electrode plate 13 may be arranged on a structure 55 arranged on the substrate 12 separately from the back plate 18.

Figure 22A:
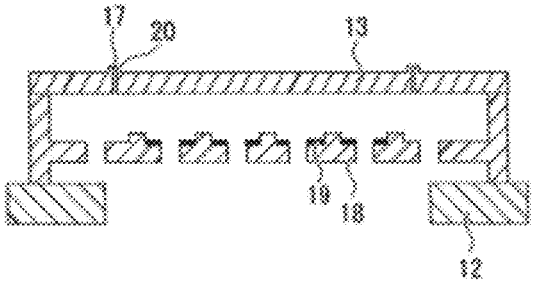
FIGS. 22A and 22B are diagrams each describing an acoustic transducer according to a modification of the embodiment.
Figure 22B:
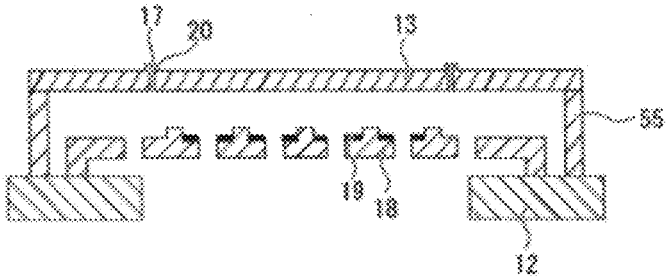
Figure 23A:
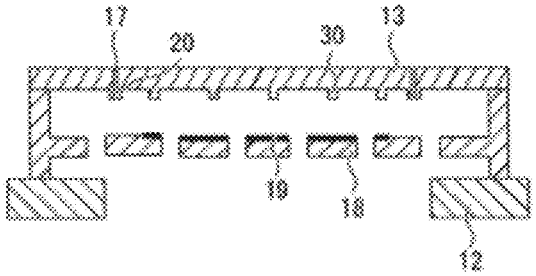
FIGS. 23A and 23B are diagrams each describing an acoustic transducer according to a modification of the embodiment.
Figure 23B:
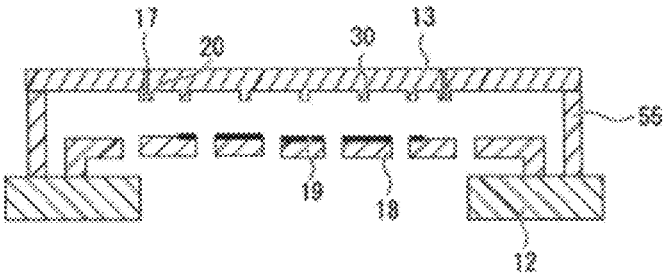

Although the structures shown in FIGS. 22A and 22B include the stoppers 30 arranged on the back plate 18, the stoppers 30 may be arranged on the vibration electrode plate 13 as shown in FIGS. 23A and 23B. When the stoppers 30 are arranged on the vibration electrode plate 13, the resistance increasing section 20 may protrude toward the back plate 18 as shown in FIGS. 23A and 23B. In this case, the resistance increasing section 20 may not be prepared separately from the stoppers 30.

REFERENCE SIGNS LIST

10 acoustic transducer
12 substrate
12*a* cavity
12*b* opening
13 vibration electrode plate
15 chamber
16 support

17 slit
18 back plate
18*a* inner side surface
19 stationary electrode plate
20 resistance increasing section
21 high-resistance surface
24 acoustic hole
26*a* leg
27, 28 wiring unit
35, 36 electrode pad
51 first sacrificial layer
52 second sacrificial layer
60 ASIC
61 circuit board
62 cover

The invention claimed is:

1. An acoustic transducer, comprising:

a stationary electrode plate; and a vibration electrode plate facing the stationary electrode plate with a space between the electrode plates, the vibration electrode plate including a slit that allows sound to pass through, wherein the slit includes a straight portion that extends substantially parallel to a peripheral side of the vibration electrode plate, the vibration electrode plate includes a resistance increasing section that increases resistance to passage of sound through the slit, and the resistance increasing section includes at least one pair of high-resistance surfaces that constitute side surfaces of the slit in a width direction and are thicker than a middle portion of the vibration electrode plate, and the high-resistance surfaces overlap in the width direction of the slit; and the resistance increasing section extends along the straight portion of the slit.

2. The acoustic transducer according to claim 1, wherein the resistance increasing section includes surfaces at the slit each of which is shaped in a square wave.

3. The acoustic transducer according to claim 1, wherein the resistance increasing section includes surfaces at the slit each of which is formed by a single high-resistance surface extending in a longitudinal direction of the slit.

4. The acoustic transducer according to claim 1, wherein the resistance increasing section protrudes from the vibration electrode plate in a direction opposite to a direction toward the stationary electrode plate.

5. The acoustic transducer according to claim 1, wherein the vibration electrode plate includes a plurality of the slits surrounding the middle portion of the vibration electrode plate, and the stationary electrode plate is within an area defined by the plurality of slits as viewed in a direction of a normal to the vibration electrode plate.

6. The acoustic transducer according to claim 1, wherein the slit is shaped to surround the middle portion of the vibration electrode plate, and the stationary electrode plate is within an area defined by the slit as viewed in a direction of a normal to the vibration electrode plate.

7. The acoustic transducer according to claim 5, wherein the stationary electrode plate and the vibration electrode plate are directly or indirectly fastened to a substrate including a cavity that opens in a first surface thereof, and at least a portion of each slit is arranged more inward from the cavity than an opening rim of the cavity of the substrate at the first surface as viewed in a direction of a normal to the first surface.

8. The acoustic transducer according to claim 6, wherein the stationary electrode plate and the vibration electrode plate are directly or indirectly fastened to a substrate including a cavity that opens in a first surface thereof, and at least a portion of each slit is arranged more inward from the cavity than an opening rim of the cavity of the substrate at the first surface as viewed in a direction of a normal to the first surface.

9. The acoustic transducer according to claim 7, wherein a peripheral portion of the vibration electrode plate is fastened to the substrate with at least one support.

10. The acoustic transducer according to claim 8, wherein a peripheral portion of the vibration electrode plate is fastened to the substrate with at least one support.

11. The acoustic transducer according to claim 9, wherein the at least one support comprises a support that fastens a portion of the vibration electrode plate outward from the slit to the substrate.

12. The acoustic transducer according to claim 10, wherein the at least one support comprises a support that fastens a portion of the vibration electrode plate outward from the slit to the substrate.

13. The acoustic transducer according to claim 1, further comprising:

a back plate to which the stationary electrode plate is attached, wherein a portion of the back plate facing each slit includes no acoustic hole.

14. The acoustic transducer according to claim 2, wherein the vibration electrode plate is prepared by forming a plate member including a slit structure with a longitudinal cross-section shaped in a square wave, and removing a middle portion of the slit structure in a transverse direction of the slit structure.

15. An acoustic transducer, comprising:

a back plate;

a stationary electrode plate attached to the back plate; and a vibration electrode plate facing the stationary electrode plate with a space between the electrode plates, the vibration electrode plate including a slit that allows sound to pass through, wherein the slit includes a straight portion that extends substantially parallel to a peripheral side of the vibration electrode plate, the vibration electrode plate includes a resistance increasing section that increases resistance to passage of sound through the slit, and the resistance increasing section includes at least one pair of high-resistance surfaces that constitute side surfaces of the slit in a width direction and are thicker than a middle portion of the vibration electrode plate, and the high-resistance surfaces overlap in the width direction of the slit;

the resistance increasing section extends along the straight portion of the slit; and a portion of the back plate facing the slit has no acoustic hole.

16. A microphone, comprising:

the acoustic transducer according to claim 1; and an integrated circuit configured to amplify an output of the acoustic transducer.

* * * * *